US006866205B2

(12) United States Patent
Bennett et al.

(10) Patent No.: US 6,866,205 B2
(45) Date of Patent: Mar. 15, 2005

(54) APPARATUS FOR GENERATING A FLAME OUT OF A LIQUID

(75) Inventors: Robb Edward Bennett, New Prague, MN (US); Gary Lee Butler, Silver Lake, MN (US); Thomas J. Bachinski, Lakeville, MN (US); David J. Oja, Burnsville, MN (US)

(73) Assignee: HON Technology Inc., Muscatine, IA (US)

( * ) Notice: Subject to any disclaimer, the term of this patent is extended or adjusted under 35 U.S.C. 154(b) by 196 days.

(21) Appl. No.: 10/067,135

(22) Filed: Feb. 4, 2002

(65) Prior Publication Data

US 2003/0146293 A1 Aug. 7, 2003

(51) Int. Cl.[7] ..... F21S 8/00
(52) U.S. Cl. ..... 239/18; 40/407
(58) Field of Search ..... 239/12, 17, 18, 239/211; 126/500, 508; 40/407

(56) References Cited

U.S. PATENT DOCUMENTS 3,565,337 A * 2/1971 Ditto ..... 239/18
4,858,826 A * 8/1989 Robinson et al. ..... 239/18
5,092,312 A 3/1992 Zolow
5,961,042 A 10/1999 Doyle
6,257,497 B1 * 7/2001 Pham ..... 239/17
6,565,940 B1 * 5/2003 Lin ..... 428/64.1

OTHER PUBLICATIONS

Mirage Volcano, Las Vegas, NV, May 1996; WET Design's Internet website at http://www.wetdesign.com/client/mirage/mirage.htm; 2 pages.

* cited by examiner

*Primary Examiner*—David A. Scherbel
*Assistant Examiner*—Thach H. Bui
(74) *Attorney, Agent, or Firm*—Merchant & Gould P.C.

(57) ABSTRACT

An apparatus for generating a combustible gas flame above a surface of a liquid. The apparatus may include a manifold including a manifold space that is completely or partially positioned within the liquid and a combustible gas source. Combustible gas from the gas source may be delivered to the manifold space and delivered into the liquid or a space above the liquid. The combustible gas may then be ignited to create a combustible gas flame. The combustible gas may also be mixed with air or liquid prior to delivery to the manifold space. In addition, a pump may be included to pump a supply of liquid out a liquid outlet to create a desired effect. Alternatively, the apparatus may be disposed on a float on the surface of the liquid.

37 Claims, 8 Drawing Sheets

APPARATUS FOR GENERATING A FLAME OUT OF A LIQUID

TECHNICAL FIELD

The present invention relates to an apparatus for generating a flame. More particularly, the invention relates to an apparatus for generating a flame above a surface of a liquid.

BACKGROUND

Flames and bodies of water are known for their aesthetically-pleasing qualities. For example, many homes include one or more fireplaces for the aesthetic appeal of the flames created therein. In addition, ponds, fountains, whirlpools, saunas, swimming pools, and other bodies of water are known to provide a calming effect and consequently be pleasing to the observer. Therefore, it may be desirable to combine the aesthetics of a flame with the calming effects of a body of water to produce an effect that is eye-catching, aesthetically-pleasing, and soothing.

Systems are known that include both flame and liquid elements. For example, systems are known wherein a flame is provided above a body of water in conjunction with a plurality of fountain elements. However, these systems are typically designed for large-scale presentations and are therefore complex to use and inflexible to implement.

Thus, there is a need for an apparatus that can be used to generate a flame above a surface of a liquid that is less complex and more versatile.

SUMMARY

Generally, the present invention relates to an apparatus for generating a flame. More particularly, the invention relates to an apparatus for generating a flame above a surface of a liquid.

In one aspect, the invention relates to an apparatus for generating a combustible gas flame above a surface of a liquid including a manifold completely disposed within the liquid and defining a manifold space and at least one aperture, and a combustible gas source configured to deliver combustible gas to the manifold space, and wherein the manifold delivers the combustible gas into the liquid through the at least one aperture, and wherein the combustible gas evolves from the liquid for ignition into the combustible gas flame.

In another aspect, the invention relates to an apparatus for generating a combustible gas flame above a surface of a liquid including a manifold at least partially disposed within the liquid and defining a manifold space and at least one aperture, a gas tube defining a gas passage coupled to a combustible gas source, the gas passage being configured to deliver a combustible gas from the combustible gas source to the manifold space, wherein the manifold delivers the combustible gas through the at least one aperture for ignition into the combustible gas flame, and at least one liquid tube defining a liquid passage positioned below the manifold, wherein the liquid passage surrounds the gas passage and is coupled to a pump configured to deliver a supply of liquid from the pump to a liquid outlet, the liquid tube at least partially defining the liquid outlet.

In yet another aspect, the invention relates to an apparatus for generating a combustible gas flame above a surface of a liquid including a manifold at least partially disposed within the liquid and defining a manifold space, a combustible gas source, wherein the combustible gas source is configured to deliver combustible gas to the manifold space through a tube defining a passage, and a pump, wherein the pump is configured to deliver a supply of liquid to the manifold through the passage. The combustible gas is introduced into the supply of liquid and the combustible gas and the supply of liquid are delivered to the manifold space through the passage and are discharged from the manifold for ignition into the combustible gas flame.

In yet another aspect, the invention relates to an apparatus for generating a combustible gas flame above a surface of a liquid including a float configured to float on the surface of the liquid, a manifold disposed on the float and defining a manifold space and at least one aperture, and a combustible gas source disposed on the float and coupled to the manifold, wherein the combustible gas source delivers combustible gas to the manifold space and wherein the combustible gas is delivered from the manifold for ignition into the combustible gas flame.

In another aspect, the invention relates to a method for generating a combustible gas flame above a surface of a liquid, the method comprising steps of: providing a manifold defining a manifold space, wherein the manifold is constructed to be completely disposed within the liquid to discharge combustible gas into the liquid and allow the combustible gas to evolve from the liquid to be ignited above the surface of the liquid; and providing a gas tube to supply combustible gas to the manifold space.

In another aspect, the invention relates a method for generating a combustible gas flame above a surface of a liquid, the method comprising steps of: providing a manifold for discharge of combustible gas; providing a gas tube to define a gas passage to deliver the combustible gas from a combustible gas source to the manifold, wherein the gas is ignited above the surface of the liquid; and providing a liquid tube surrounding the gas tube, wherein the liquid tube and gas tube define a liquid passage for the delivery of a supply of liquid to a liquid outlet for discharge.

In a further aspect, the invention relates to a method for generating a combustible gas flame above a surface of a liquid, the method comprising steps of: providing a combustible gas source for providing combustible gas; providing an apparatus including a manifold defining a manifold space, wherein the apparatus is at least partially disposed within the liquid; providing a supply of liquid to the apparatus; swirling the supply of liquid in the apparatus to create a center portion substantially free of the supply of liquid; introducing the combustible gas into the center portion; providing the combustible gas and the supply of liquid to the manifold space; discharging the supply of liquid and the combustible gas from the manifold; and igniting the combustible gas to create the combustible gas flame.

In a further aspect, the invention relates to an apparatus for generating a combustible gas flame above a surface of a liquid including a manifold at least partially disposed within the liquid and defining a manifold space, means for delivering combustible gas to the manifold space for ignition to create the combustible gas flame, and means for delivering a supply of liquid for delivery to a liquid outlet defined by the apparatus.

The above summary of the present invention is not intended to describe each disclosed embodiment or every implementation of the present invention. Figures in the detailed description that follow more particularly exemplify embodiments of the invention. While certain embodiments will be illustrated and describing embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

Figure 1:
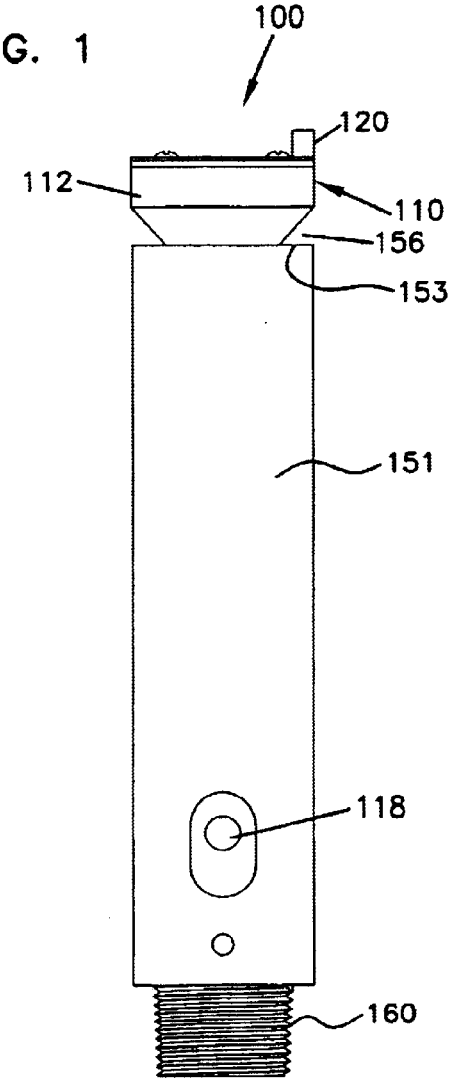
FIG. 1 is a side view of a first example embodiment of an apparatus made in accordance with the present invention.

While the invention is amenable to various modifications and alternant forms, specifics thereof have been shown by way of example and the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The invention is applicable to an apparatus for generating a flame. More particularly, the invention relates to an apparatus for generating a flame above a surface of a liquid. While the present invention is not so limited, an appreciation of the various aspects of the invention will be gained through a discussion of the examples provided below.

An apparatus made in accordance with this invention may generally create a flame above a surface of a liquid, the apparatus preferably being disposed at least partially in the liquid. As used herein, the term "flame" indicates any type of combustion created when a combustible material, such as a combustible gas, for example, natural gas, LP gas, or mixtures thereof with air, is ignited using any known type of ignition, such as, for example, a manual or electronic ignition, to create a flame. The term "liquid" is used herein to denote any body of liquid, such as, for example, a pond, lake, river, fountain, water display, Jacuzzi, sauna, swimming pool, or other such body wherein it would be desirable to add a flame. The term "liquid" should not be interpreted to be limited to water, but may also include other non-combustible liquids, composite liquids, or gels. The liquid may contain dissolved or dispersed materials or compounds therein. Further, the phrase "above a surface of a liquid" is used to generally denote any space above the surface of the liquid, including the point at which the flame originates from or touches the surface as well as any other point above the surface.

Referring now to FIGS. 1–6, an example apparatus 100 made in accordance with a first embodiment of the invention is shown. The apparatus 100 generally includes a manifold assembly 110, a liquid assembly 150, and an outer cylindrical sleeve 151. The manifold assembly 110, shown in cross-section in FIG. 5 and exploded in FIG. 6, includes a manifold 112 and a cylindrical portion 169. The manifold 112 defines manifold space 170 that is fluidly coupled to a gas intake 116 and a gas passage 114 defined by a gas tube 115 disposed in the cylindrical portion 169, as described below. Optionally, an air intake 118 can also be coupled to the manifold 112 through the gas passage 114.

The gas intake 116 may be coupled to a combustible gas source (not shown) to provide a combustible gas such as, for example, natural gas or LP gas. In addition, a gas/air mixture may alternatively be supplied to the gas intake 116. Gas delivered to the gas intake 116 is directed through the gas passage 114 and into the manifold space 170 of the manifold 112. If an additional air source is desired, air from the air intake 118 may also be introduced into the manifold via the passage 114. Air from the air intake 118 may mix with the gas from the gas intake 116. The manifold 112, in turn, allows the gas or gas/air mixture to evolve from the manifold space 170 of the manifold 112 via one or more apertures 113 defined in a top surface of the manifold 112 and into a space above the manifold 112.

The apertures 113 may be arranged in specific patterns to create the desire flame shape and effect. In addition, although multiple apertures 113 are shown, a single aperture can be used to deliver combustible gas for combustion. The combustible gas which exits or discharges from the manifold 112 may be ignited by an electronic ignition and flame-sensing assembly 120 to form a combustible gas flame. Alternatively, the combustible gas can be ignited manually. Both the electronic and manual ignition systems are described in greater detail below.

Figure 5:
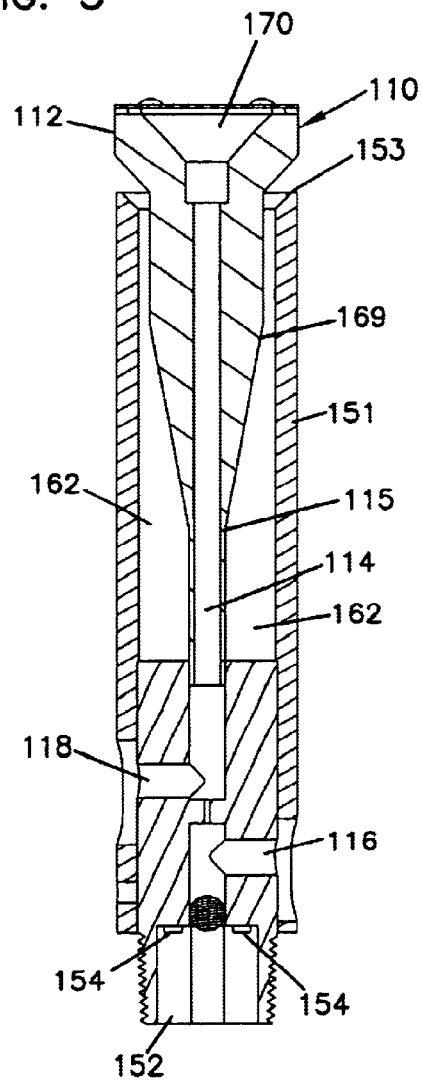
FIG. 5 is a cross-sectional view of the apparatus taken along line C—C of FIG. 3.
Figure 6:
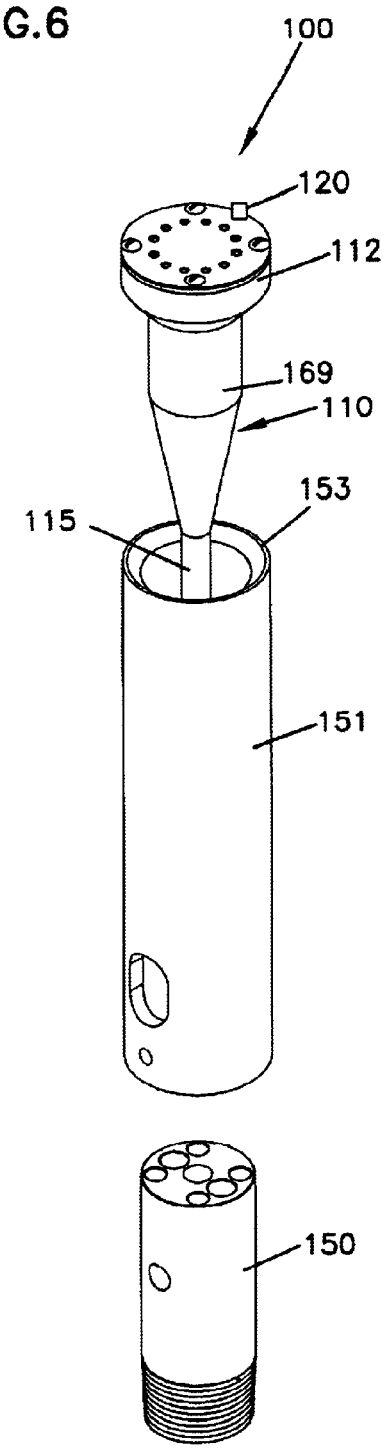
FIG. 6 is an exploded view of the apparatus of FIG. 1.
Figure 2:
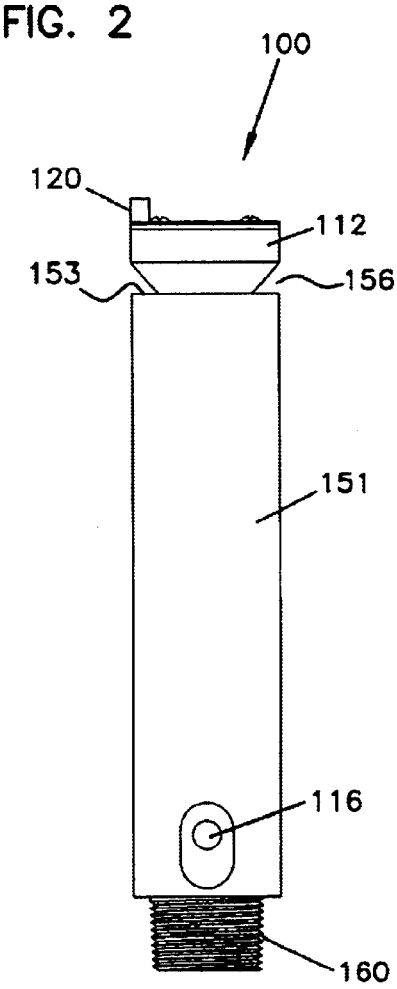
FIG. 2 is an opposite side view of the apparatus of FIG. 1.
Figure 3:
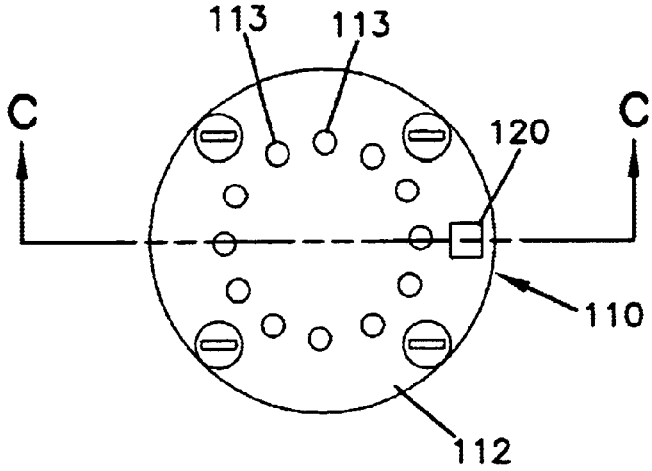
FIG. 3 is a top view of the apparatus of FIG. 1.
Figure 4:
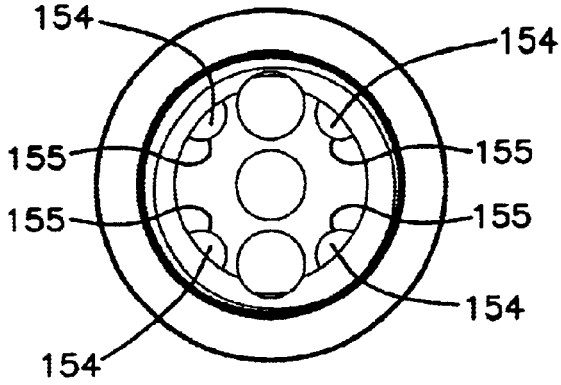
FIG. 4 is a bottom view of the apparatus of FIG. 1.

The liquid assembly 150, shown in cross-section in FIG. 5 and exploded in FIG. 6, includes the gas intake 116, liquid intake 152, a circumferential liquid outlet 156, and a plurality of liquid passages 154 defined by a plurality of liquid tubes 155 fluidly connecting the liquid intake 152 to a cavity 162 formed between the manifold assembly 110 and the outer sleeve 151. The cavity 162, in turn, opens into the liquid outlet 156. The liquid intake 152 may be coupled via threads 160 to a pump (not shown) that provides a supply of liquid under a pressure sufficient to cause the supply of liquid to travel through one or more of the plurality of liquid passages 154 and through the liquid outlet 156. The liquid outlet 156, as shown, is defined between an end 153 of the sleeve 151 and the manifold 112. Alternatively, the liquid outlet 156 may be completely defined by the liquid tubes 155 themselves. In addition, the liquid outlet 156 may alternatively be positioned above the manifold 112 by extending the liquid passages 154 beyond the manifold 112 so that the supply of liquid exits into the space above that of the manifold 112.

The supply of liquid may originate from at least three sources: (1) the supply of liquid may originate from the liquid (i.e. it is drawn from the liquid that the apparatus is disposed within); (2) the supply of liquid may originate from a separate source; or (3) the supply of liquid may originate and be recycled from the supply of liquid itself (i.e. the supply of liquid may be segregated from the liquid that the apparatus is disposed within and the supply of liquid may be recycled through the apparatus).

The configuration of the apparatus 100 illustrated in FIGS. 1–6 and described above is by way of example only, and other configurations are possible. For example, it is not necessary for the plurality of liquid passages 154 and the cavity 162 to surround the gas passage 114. The plurality of liquid passages 154 could simply run side-by-side with the gas passage 114, or alternatively, the gas passage 114 could surround the liquid passages 154. In addition, the plurality of liquid tubes 155 and passages 154 could be replaced with a single passage and/or multiple gas passages may be provided.

The apparatus 100 may operate as follows. The apparatus 100 may be partially or fully disposed within a liquid. If the apparatus 100 is partially disposed with the liquid, at least a portion of the manifold 112 may be positioned above a surface of the liquid. Positioned in this manner, combustible gas is provided from the gas intake 116, through the gas passage 114, and out the apertures 113 formed in the manifold 112. Air may also be provided from the air intake 118 and mixes with the combustible gas. Once the combustible gas evolves from the manifold 112 into the space above the liquid, the gas is ignited or continually combusted after ignition to create a combustible gas flame.

If the apparatus 100 is completely disposed within the liquid (i.e. the apparatus is positioned below the surface of the liquid), the combustible gas may be delivered by the manifold 112 directly into the liquid. The combustible gas may then evolve from the liquid at the surface and be combusted using a manual or electronic ignition system, thereby creating a combustible gas flame on or above the surface of the liquid. In the example embodiment, the manifold 112 may be placed 3 inches or less from the surface of the liquid. However, the manifold 112 may be placed closer or further away from the surface of the liquid depending on the volume of gas that is introduced into the liquid by the manifold 112.

If the liquid outlet 156 is positioned above the surface of the liquid, the supply of liquid provided from the liquid intake 152 and through the plurality of liquid passages 154 may exit the liquid outlet 156 into the space over the surface of the liquid and fall back into the liquid. Alternatively, if the liquid outlet 156 is placed below the surface of the liquid, the supply of liquid may be directly dispensed into the liquid. Alternatively, the apparatus 100 may function without the liquid assembly 150 altogether, instead providing only the gas flame via the manifold assembly 110.

Figure 7:
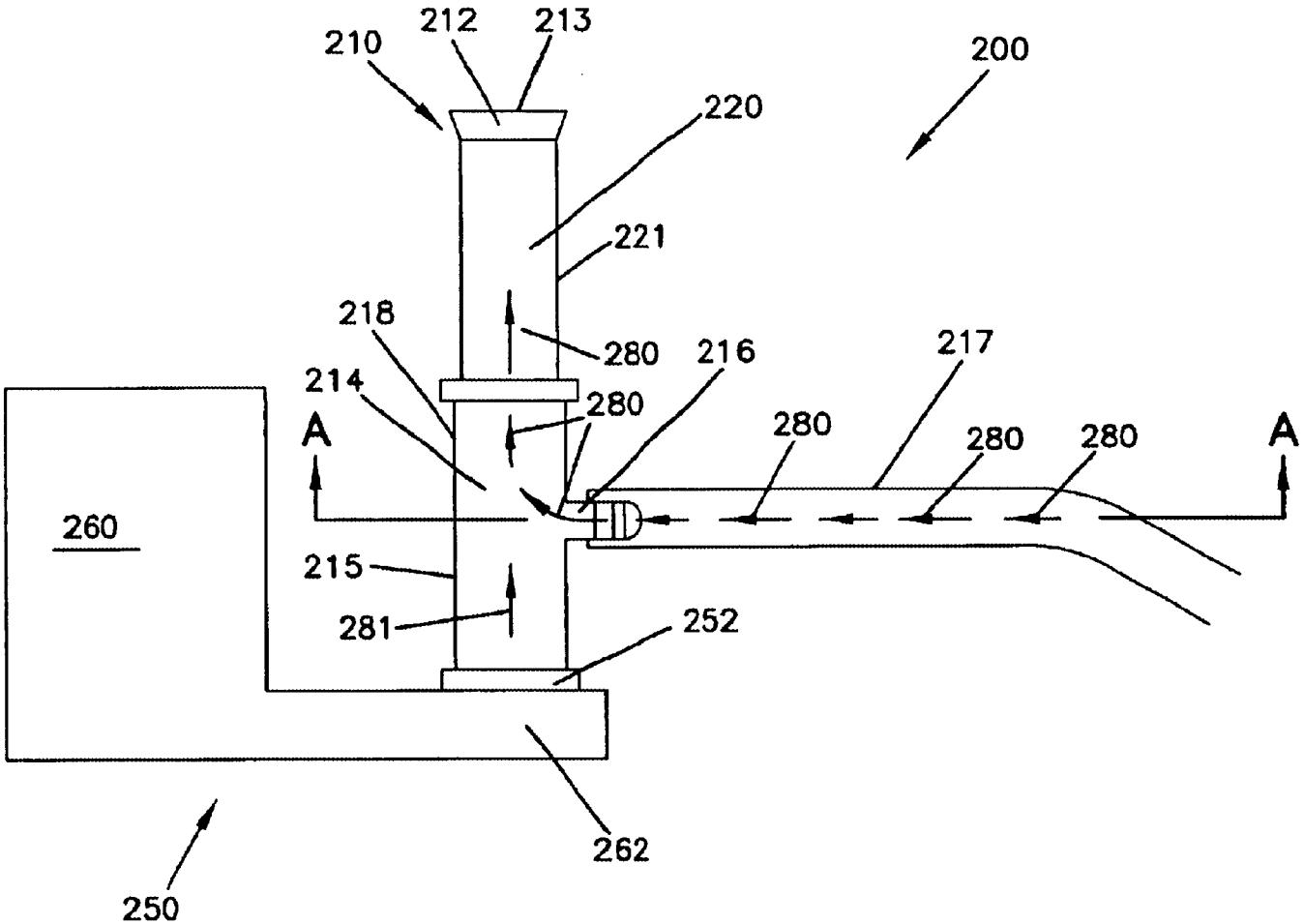
FIG. 7 is a side view of a second example embodiment of an apparatus made in accordance with the present invention.
Figure 8:
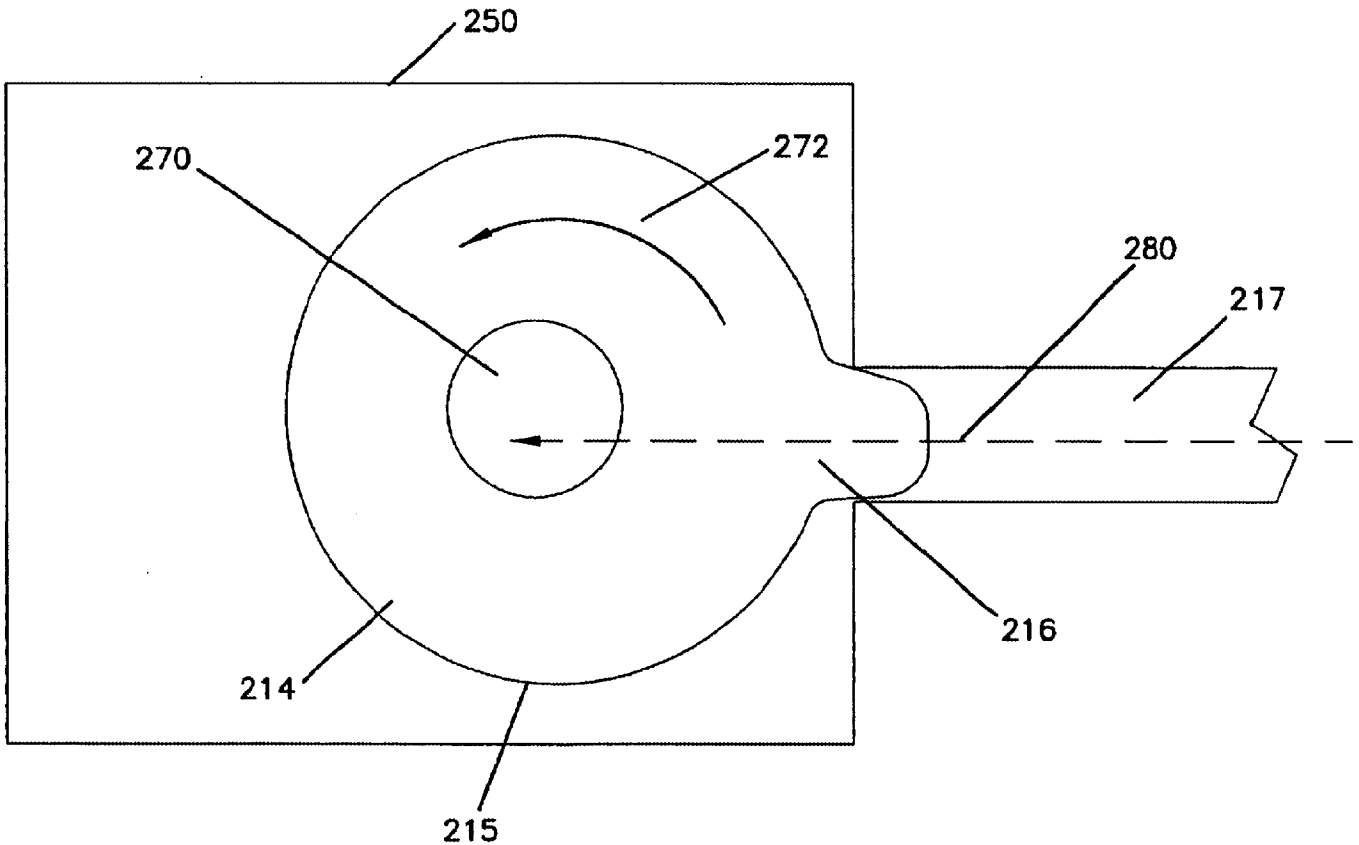
FIG. 8 is a cross-sectional view of the apparatus taken along line A—A of FIG. 7.

A second example embodiment of an apparatus 200 made in accordance with the present invention is illustrated in FIGS. 7 and 8. The apparatus 200 functions in a manner similar to that of the apparatus 100, with exceptions noted below. The apparatus 200 includes a manifold assembly 210 and a liquid assembly 250. The manifold assembly 210 includes a gas intake 216 coupled to a gas source 217, a manifold 212, and a passage 214 defined by a tube 218 with a cylindrical wall 215 coupled to an upper passage 220 defined by an upper tube 221. Alternatively, a single tube could also be used instead of separate tube 218 and upper tube 221. The passages 214 and 220 together couple the gas intake 216 to the manifold 212. The manifold 212, as described below, may include one or more apertures 213 formed therein to allow the gas to evolve from the manifold 212.

The liquid assembly 250 includes a liquid intake 252 coupled to a liquid pump 260. The pump 260 provides a supply of liquid to the liquid intake 252. In addition, the pump 260 includes a rotary assembly 262 positioned axially with respect to the liquid intake 252. The rotary assembly 262 includes a propeller (not shown) that causes the supply of liquid to spin or swirl at a given rate. This spinning motion causes the supply of liquid, upon exiting the liquid pump 260 into the liquid intake 252, to be centrifugally-forced against the cylindrical wall 215 of the passage 214, thereby creating a central portion 270 of the passage 214 generally void of any liquid contained therein, as is shown in the cross-sectional view of FIG. 8 taken along line A—A of FIG. 7.

The apparatus 200 may operate as follows. Once again, the apparatus 200 may be partially disposed within a liquid or may be completely disposed within the liquid. A supply of liquid is provided by the pump 260 to the liquid intake 252. As the supply of liquid exits the pump 260, it is spun via the rotary assembly 262. As the supply of liquid enters the liquid intake 252 in a direction indicated by arrow 281, the spinning motion, such as in a direction 272, is centrifugally-forced against the cylindrical wall 215 of the passage 214, thereby creating the central portion 270 which is generally void of any supply of liquid.

Combustible gas from the gas source 217 enters the passage 214 via the gas intake 216 in a direction indicated by arrows 280 and is introduced into and at least partially fills the central portion 270. The supply of liquid and the gas are carried in this manner up the passages 214 and 220 until both the combustible gas and the supply of liquid reach the manifold 212.

If the apparatus 200 is disposed only partially within the liquid, with at least a portion of the manifold 212 above a surface of the liquid, the combustible gas that entered the manifold 212 may evolve via the apertures 213 and be ignited by, for example, an electronic ignition and flame-sensing assembly, to create a combustible gas flame. The supply of liquid may also exit the manifold 212 in a manner similar to that of a fountain by being propelled into the space above the liquid, or, alternatively, the supply of liquid may simply exit the manifold 212 and fall back into the liquid. In an alternative embodiment (not shown), a liquid outlet may be provided in a manifold or a liquid assembly so that a supply of liquid may exit the liquid outlet rather than the apertures.

Conversely, if the apparatus 200 is disposed completely below the surface of the liquid, the supply of liquid may exit the manifold 212 into the liquid. The combustible gas may also exit from the manifold 212 via the apertures 213 into the liquid. The combustible gas may then rise to the surface of the liquid and evolve from the liquid. Once the combustible gas has evolved from the liquid and entered the space above the surface of the liquid, the combustible gas can be ignited to create the combustible gas flame.

Alternatively, instead of swirling the supply of liquid and introducing the gas into a central portion, the gas and supply of liquid may be mixed, either by using a rotary assembly or by allowing the gas and supply of liquid to mix via the pressure each is under as it enters into the respective intakes. If the mixing method is used, the gas will evolve from the supply of liquid after exiting the manifold to be combusted to create the combustible gas flame or be ignited above the surface of the liquid should the manifold be disposed completely within the liquid.

Figure 9:
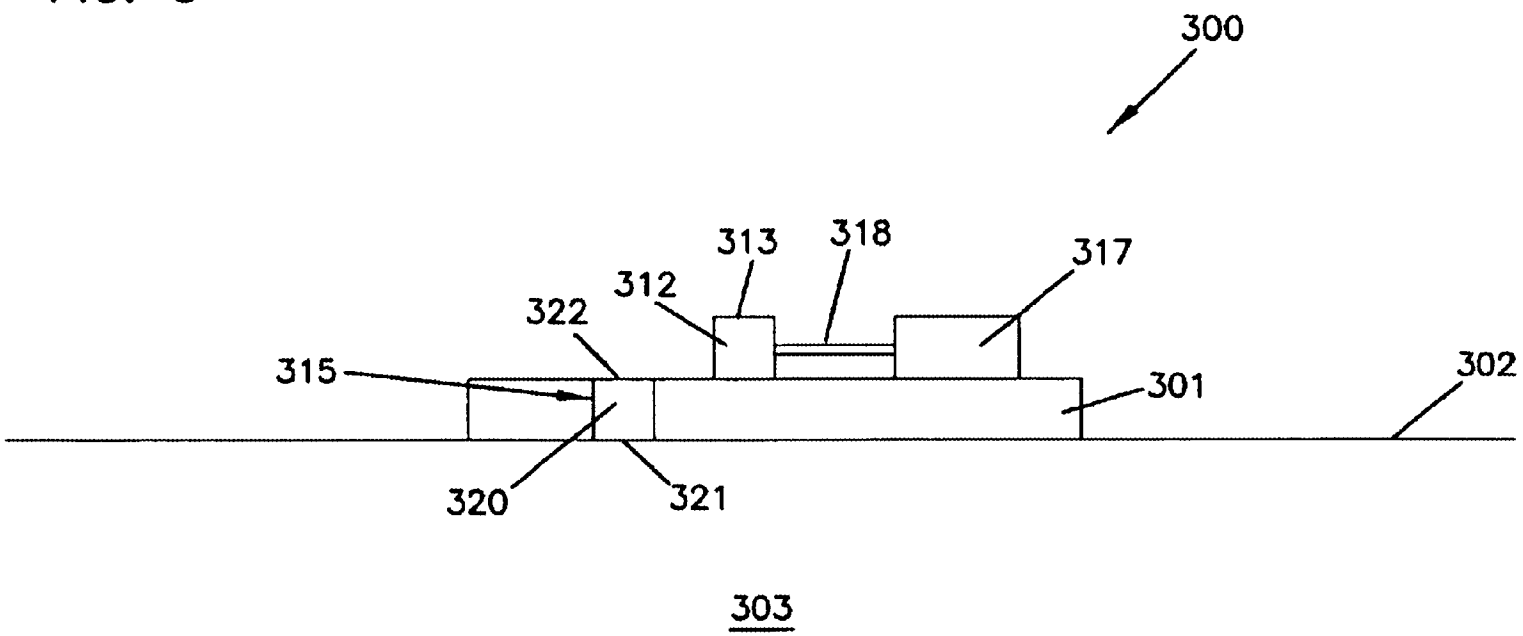
FIG. 9 is a side view of a third example embodiment of an apparatus made in accordance with the present invention.

A third example embodiment of an apparatus 300 made in accordance with the present invention is illustrated in FIG. 9. The apparatus 300 includes a manifold 312 coupled through a gas passage 318 to a combustible gas source 317. The combustible gas source 317 may be a self-contained unit or may be coupled to a separate source of combustible gas (not shown). In the example embodiment, the gas source 317 comprises a 1 lb. LP gas cylinder. The apparatus 300 also includes a float 301 on which the manifold 312 and the gas source 317 are positioned. The float 301 is constructed so that the apparatus 300 floats on a surface 302 of a liquid 303. In an example embodiment, the float 301 is made of Styrofoam, although any material that floats may be used.

A pump 315 may also be included on the float 301 and configured so that a pump inlet 321 defined by the pump 315 is in fluid communication with the liquid 303 and a pump outlet 322 defined by the pump 315 opens into a space above the surface 302 of the liquid 303. A passage 320 also defined by the pump 315 connects the pump inlet 321 and the pump outlet 322. The pump 315 may be configured to operate on battery or other alternative power sources, such as solar energy or a direct electrical wiring connection.

The apparatus 300 may operate as follows. Combustible gas is supplied from the gas source 317 through the gas passage 318 to the manifold 312. The combustible gas is discharged from the manifold 312 through one or more apertures 313 defined in a top surface of the manifold 312 and is ignited or continually combusted after ignition to create a combustible gas flame. In addition, the pump 315 may function to pump a supply of liquid from the pump inlet 321, through the passage 320, and out the pump outlet 322, where the liquid may enter the space above the surface 302 of the liquid and then fall back into the liquid 303. The liquid may exit the pump outlet 322 in a variety of ways to create the desired effect.

Additional components and/or assemblies may be added to or used in conjunction with the apparatus 100 and 200. For example, an electronic ignition and flame-sensing assembly such as 120, shown in FIG. 1, may be utilized, as is known in the art. The electronic ignition may include electrical components such as an electrode to create a spark and thereby ignite the combustible gas to create the combustible gas flame. The flame-sensing portion of the assembly may sense when the combustible gas flame is extinguished and attempt to re-ignite the combustible gas. In addition, the flame-sensing portion may, after a certain time-interval of unsuccessful re-ignition, such as, for example, 5 seconds, turn off the combustible gas supply to avoid excess accumulation of non-combusted gas. Alternatively, if the electronic ignition and flame-sensing assembly 120 is not desired, ignition can be accomplished using a variety of other methods, such as, for example, simply igniting the combustible gas using a lighter or through use of a pilot.

A variety of on-off assemblies may be utilized in conjunction with the electronic ignition and flame-sensing assembly. The on-off assemblies allow the user to turn the apparatus on and off. On-off assemblies may include a switch with on and off positions or a variable switch to allow the user to vary the size of the flame and/or the supply of liquid. In addition, an automatic on-off switch may be employed using, for example, a photoelectric cell. The photoelectric cell may be configured to measure the amount of available light and turn the apparatus on when it is sufficiently dark and turn the apparatus off when it is sufficiently light. Other configurations for on-off assemblies may also be employed.

Figure 10:
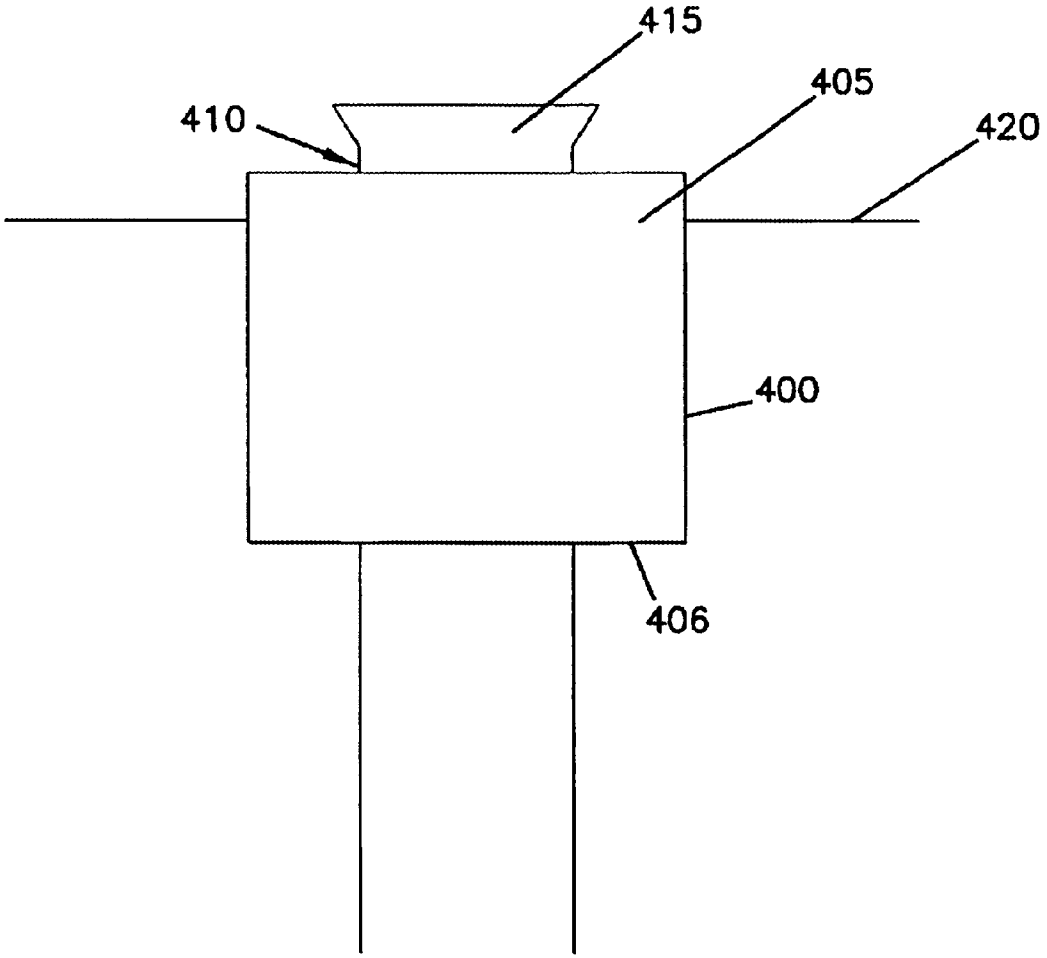
FIG. 10 is a side view of a fourth example embodiment of an apparatus made in accordance with the present invention including an example embodiment of an isolation assembly.
Figure 11:
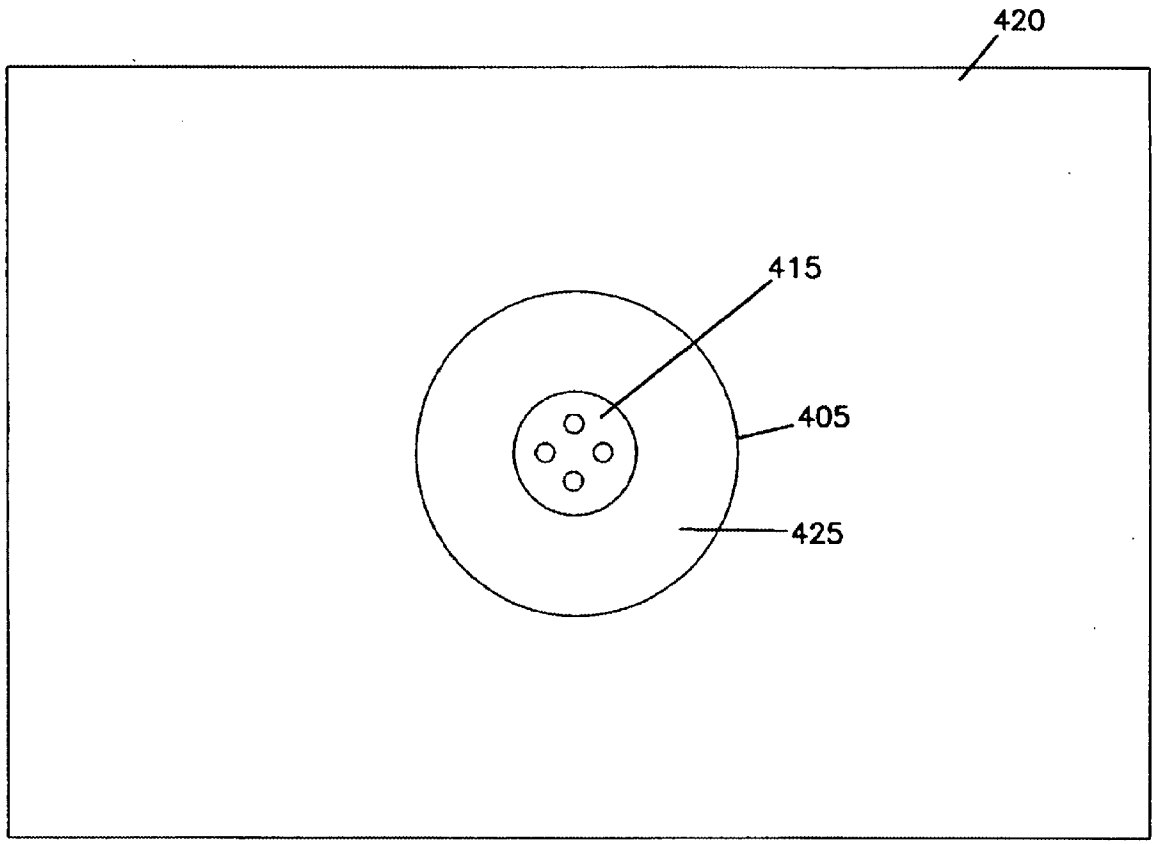
FIG. 11 is a top view of the apparatus including the isolation assembly of FIG. 10.

The apparatuses 100, 200, and 300 may also include an isolation assembly, such as isolation assembly 400 shown in FIGS. 10 and 11. An isolation assembly may be desirable to segregate the supply of liquid from the liquid in which the apparatus is disposed. For example, the supply of liquid may include materials in the supply of liquid that may not be desirable to allow to mix with the liquid. In addition, it may be undesirable to mix the supply of liquid with the liquid if the supply of liquid is maintained at a higher temperature than the liquid. The isolation assembly 400 may be formed to include a cylindrical wall 405 surrounding a manifold 415 of an apparatus 410. Also included is a base 406 of the isolation assembly 400 that is coupled in a sealing arrangement to an outer surface of the apparatus 410. In this configuration, the isolation assembly 400 isolates a supply of liquid 425 contained within the isolation assembly 400 and circulated through the apparatus 410 from entering a liquid 420 in which the apparatus 410 is generally disposed, thereby minimizing any amount of undesirable material, such as dissolved combustible gas, or thermal energy from entering the liquid 420. In this manner, other fragile components disposed within the liquid, such as, for example, fish or vegetation, can be protected.

One or more flame-enhancing substances may also be added to the liquid or the flame itself to produce desired effects. For example, coloration may be added to the liquid or the supply of liquid to produce a desired color. Also, substances may be introduced into the liquid, the supply of liquid, or the combustible flame itself to vary the color of the combustible flame. For example, flame-enhancing substances such as sodium or copper may be introduced into the combustible flame to create a flame of a certain color, such as bright orange in the instance of sodium. Other colorants and materials may also be used. In addition, other accent lights, such as, for example, electric lights disposed on the manifold or adjacent the manifold may also be provided to create a desired effect.

The present invention should not be considered limited to the particular examples or materials described above, but rather should be understood to cover all aspect of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. An apparatus for generating a combustible gas flame above a surface of a liquid, the apparatus comprising:

a manifold completely disposed within the liquid and defining a manifold space and at least one aperture; and a combustible gas source configured to deliver combustible gas to the manifold space, wherein the manifold delivers the combustible gas into the liquid through the at least one aperture, and wherein the combustible gas evolves from the liquid for ignition into the combustible gas flame.

2. The apparatus of claim 1, further comprising an air source, wherein the air source is configured to deliver air to the manifold space.

3. The apparatus of claim 1, further comprising:

a liquid outlet positioned adjacent the manifold, wherein the liquid outlet is defined by an outer surface of the apparatus; and a pump configured to deliver a supply of liquid to the liquid outlet, wherein the liquid outlet delivers the supply of liquid into the liquid.

4. The apparatus of claim 3, wherein the supply of liquid includes a flame-enhancing substance.

5. The apparatus of claim 3, further comprising an isolation assembly disposed in the liquid to surround the manifold and isolate the supply of liquid from the liquid.

6. The apparatus of claim 1, further comprising an electronic ignition and flame-sensing assembly, wherein the electronic ignition and flame-sensing assembly ignites the combustible gas as it evolves from the liquid and wherein the electronic ignition and flame-sensing assembly senses when the combustible gas flame has extinguished.

7. An apparatus for generating a combustible gas flame above a surface of a liquid, the apparatus comprising:

a manifold at least completely disposed within the liquid and defining a manifold space and at least one aperture;

a gas tube defining a gas passage coupled to a combustible gas source, the gas passage being configured to deliver a combustible gas from the combustible gas source to the manifold space, wherein the manifold delivers the combustible gas through the at least one aperture for ignition into the combustible gas flame; and at least one liquid tube defining a liquid passage positioned below the manifold, wherein the liquid passage surrounds the gas passage and is coupled to a pump configured to deliver a supply of liquid from the pump to a liquid outlet, the liquid tube at least partially defining the liquid outlet.

8. The apparatus of claim 7, wherein the apparatus includes a plurality of liquid tubes surrounding the gas passage and defining a plurality of liquid passages.

9. The apparatus of claim 7, wherein the manifold is completely disposed in the liquid, and wherein the combustible gas is discharged into the liquid and the combustible gas evolves from the liquid.

10. The apparatus of claim 7, further comprising an isolation assembly disposed in the liquid to surround the manifold and wherein the isolation assembly isolates the supply of liquid from the liquid.

11. The apparatus of claim 7, further comprising an electronic ignition and flame-sensing assembly, wherein the electronic ignition and flame-sensing assembly ignites the combustible gas as it delivered from the manifold and wherein the electronic ignition and flame-sensing assembly senses when the combustible gas flame has extinguished.

12. The apparatus of claim 7, further comprising an air source coupled to the gas passage for supplying air to mix with the combustible gas.

13. An apparatus for generating a combustible gas flame above a surface of a liquid, the apparatus comprising:

a manifold at least completely disposed within the liquid and defining a manifold space;

a combustible gas source, wherein the combustible gas source is configured to deliver combustible gas to the manifold space through a tube defining a passage; and a pump, wherein the pump is configured to deliver a supply of liquid to the manifold through the passage, wherein the combustible gas is introduced into the supply of liquid and the combustible gas and the supply of liquid are delivered to the manifold space through the passage and are discharged from the manifold for ignition into the combustible gas flame.

14. The apparatus of claim 13, wherein the pump includes a rotary assembly to swirl the supply of liquid and thereby create a middle portion substantially void of the supply of liquid, and wherein the combustible gas is introduced into the middle portion.

15. The apparatus of claim 13, wherein the pump includes a rotary assembly to mix the supply of liquid and the combustible gas to form a mixture.

16. The apparatus of claim 13, wherein the manifold is completely disposed within the liquid, and wherein the combustible gas is discharged into the liquid and the combustible gas evolves from the liquid.

17. The apparatus of claim 13, further comprising an isolation assembly disposed in the liquid to surround the manifold and isolate the supply of liquid from the liquid.

18. The apparatus of claim 13, further comprising an electronic ignition and flame-sensing assembly, wherein the electronic ignition and flame-sensing assembly ignites the combustible gas as it evolves from the supply of liquid and wherein the electronic ignition and flame-sensing assembly senses when the combustible gas flame has extinguished.

19. An apparatus for generating a combustible gas flame above a surface of a liquid, the apparatus comprising:

a float configured to float on the surface of the liquid;

a manifold disposed on the float and defining a manifold space and at least one aperture; and a combustible gas source disposed on the float and coupled to the manifold, wherein the combustible gas source delivers combustible gas to the manifold space, and wherein the combustible gas is delivered from the manifold for ignition into the combustible gas flame.

20. The apparatus of claim 19, further comprising a pump disposed on the float, the pump defining a pump inlet positioned to be in fluid communication with the liquid and the pump defining a pump outlet coupled to the pump inlet through a passage, wherein the pump is configured to deliver liquid from the pump inlet, through the passage, and out the pump outlet.

21. A method for generating a combustible gas flame above a surface of a liquid, the method comprising steps of:

providing a manifold defining a manifold space, wherein the manifold is constructed to be completely disposed within the liquid to discharge combustible gas into the liquid and allow the combustible gas to evolve from the liquid to be ignited above the surface of the liquid; and providing a gas tube to supply combustible gas to the manifold space.

22. A method for generating a combustible gas flame above a surface of a liquid, the method comprising steps of:

providing a manifold for discharge of combustible gas;

providing a gas tube to define a gas passage to deliver the combustible gas from a combustible gas source to the manifold, wherein the gas is ignited above the surface of the liquid; and providing a liquid tube surrounding the gas tube, wherein the liquid tube and gas tube define a liquid passage for the delivery of a supply of liquid to a liquid outlet for discharge.

23. The method of claim 22, further comprising steps of:

positioning the liquid outlet in the space above the liquid; and allowing the liquid to exit the liquid outlet into the liquid.

24. A method for generating a combustible gas flame above a surface of a liquid, the method comprising steps of:

providing a combustible gas source for providing combustible gas;

providing an apparatus including a manifold defining a manifold space, wherein the apparatus is at least completely disposed within the liquid;

providing a supply of liquid to the apparatus;

swirling the supply of liquid in the apparatus to create a center portion substantially free of the supply of liquid;

introducing the combustible gas into the center portion;

providing the combustible gas and the supply of liquid to the manifold space;

discharging the supply of liquid and the combustible gas from the manifold; and igniting the combustible gas to create the combustible gas flame.

25. A method of generating a fire and water display using a fire and water display device, the device including a combustible gas device and a water distribution device, the combustible gas device including a plurality of openings, the method comprising the steps of:

delivering combustible gas to the plurality of openings of the combustible gas device and igniting the combustible gas to produce a plurality of flames that extend upward from the combustible gas device, a flame being formed at each of the plurality of openings; and delivering water to the water distribution device and directing the delivered water toward the flame.

26. The method of claim 25, wherein the fire and water display device further includes a water reservoir and the method further comprises collecting the dispersed water.

27. The method of claim 25, further comprising shielding the flames from the directed water by diverting the directed water away from the flames.

28. The method of claim 25, wherein directing the delivered water includes moving the delivered water through a conduit that is directed towards the flames.

29. The method of claim 25, further comprising shielding the flames from the directed water by engaging the directed water against a portion of the combustible gas device adjacent the plurality of flames that is configured to divert the directed water away from the flames.

30. A method of generating a fire and water display using a fire and water display device, the device including a combustible gas device and a water distribution device, the method comprising the steps of:

delivering combustible gas to the combustible gas device and igniting the combustible gas to produce a plurality of flames that extend upward from the combustible gas device;

delivering water to the water distribution device and directing the delivered water toward the flame; and shielding the flames from the directed water by contacting the directed water against a beveled edge of the combustible gas device that is positioned adjacent the plurality of flames thereby preventing the water from extinguishing the flames.

31. The method of claim 30, wherein the fire and water display device further includes a water reservoir and the method further comprises collecting the dispersed water.

32. The method of claim 30, wherein contacting the directed water against the beveled edge of the combustible gas device diverts the directed water away from the flames.

33. The method of claim 30, wherein directing the delivered water includes moving the delivered water through a conduit that is directed towards the flames.

34. The method of claim 30, wherein the combustible gas device includes a plurality of openings, and the delivering step includes delivering the combustible gas to the plurality of openings for formation of a flame at each opening.

35. A method of generating a fire and water display using a fire and water display device, the device including a combustible gas device and a water distribution device, the method comprising the steps of:

delivering combustible gas to the combustible gas device and igniting the combustible gas to produce a plurality of flames that extend upward from the combustible gas device;

delivering water to the water distribution device and directing the delivered water toward the flame; and shielding the flames from the directed water by contacting the directed water against a surface of the combustible gas device that is positioned adjacent the plurality of flames.

36. An apparatus for generating a combustible gas flame above a surface of a liquid, the apparatus comprising:

a manifold completely submerged below a surface of the liquid and defining a manifold space and at least one aperture; and a combustible gas source configured to deliver combustible gas to the manifold space, wherein the manifold delivers the combustible gas into the liquid through the at least one aperture, and wherein the combustible gas evolves from the liquid for ignition into the combustible gas flame.

37. The apparatus of claim 19, wherein the combustible gas source includes a gas storage container that holds combustible gas for delivery to the manifold space.

* * * * *